US005791926A

United States Patent [19]

Zeiss

[11] Patent Number: 5,791,926

[45] Date of Patent: Aug. 11, 1998

[54] PLUG-IN CONNECTOR FOR AN ELECTRICAL SYSTEM, IN PARTICULAR FOR MOTOR-VEHICLE INSTRUMENT CLUSTERS

[75] Inventor: Manfred Zeiss, Rüsselsheim, Germany

[73] Assignee: VDO Adolf Schindling AG, Frankfurt, Germany

[21] Appl. No.: 761,161

[22] Filed: Dec. 6, 1996

[30] Foreign Application Priority Data

Dec. 23, 1995 [DE] Germany ..... 195 48 561.0

[51] Int. Cl.[6] ..... H01R 13/62

[52] U.S. Cl. ..... 439/259; 439/347

[58] Field of Search ..... 439/259–267, 439/341, 347

[56] References Cited

U.S. PATENT DOCUMENTS

| | | | |
|---|---|---|---|
| 2,987,693 | 6/1961 | Wamsley | 439/157 |
| 4,456,318 | 6/1984 | Shibata et al. | 439/261 |
| 4,976,629 | 12/1990 | Werner | 439/259 |
| 5,409,393 | 4/1995 | Perkins et al. | 439/347 |
| 5,517,387 | 5/1996 | Smith | 439/259 |

FOREIGN PATENT DOCUMENTS 2245033 3/1974 Germany .

*Primary Examiner*—Hien Vu
*Attorney, Agent, or Firm*—Martin A. Farber

[57] ABSTRACT

A plug-in connector for an electric system, in particular for motor-vehicle instrument clusters, in which an electrical contact arranged in a first connector part can be detachably connected by an actuating device with a mating contact which is fastened in a second connector part. In order to fasten the indicating device in an easy and inexpensive manner to the instrument board and, at the same time, permit a reliable electric contact to be made, the electric contact is connected to the electric mating contact by a linear movement of the actuating device within the first connector part which has the electric contact and is fastened on a circuit board. The second connector part is firmly attached to a support element. During the contacting of contact and mating contact, the first connector part can be simultaneously locked with the support element by a locking device for the actuating device which protrudes beyond the first connector part in the direction of movement.

7 Claims, 2 Drawing Sheets

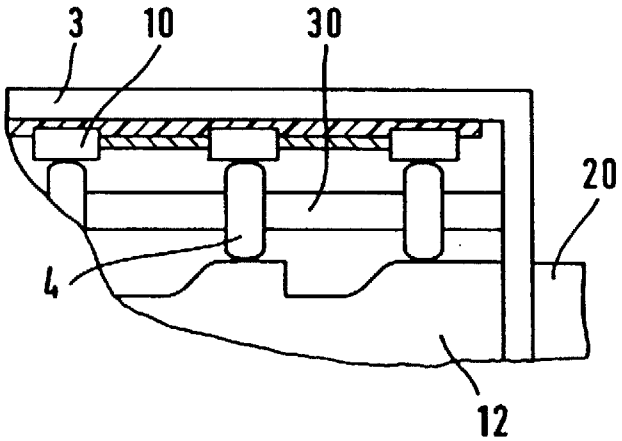
Fig.2b
Fig. 2
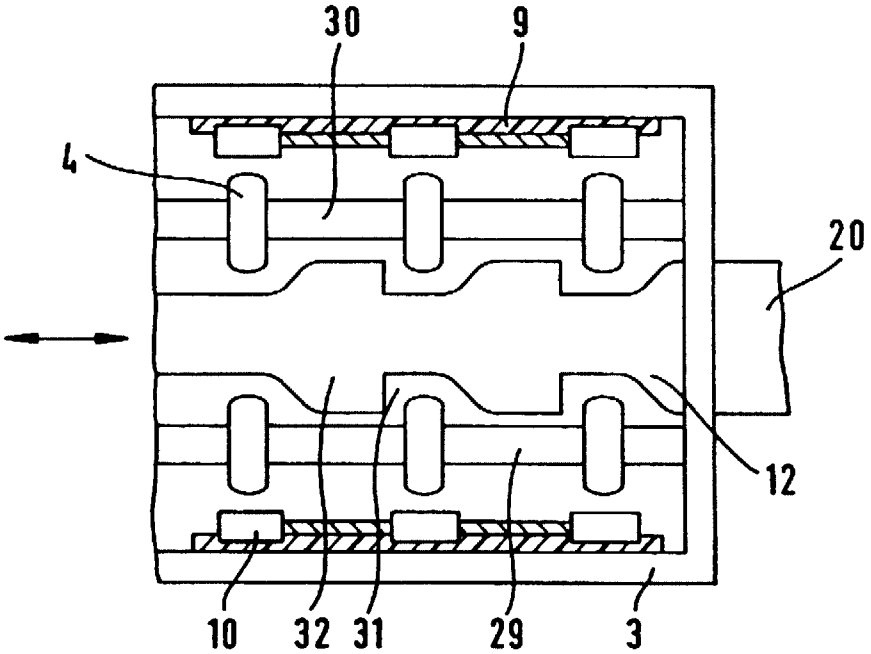
Fig.2a

PLUG-IN CONNECTOR FOR AN ELECTRICAL SYSTEM, IN PARTICULAR FOR MOTOR-VEHICLE INSTRUMENT CLUSTERS

FIELD AND BACKGROUND OF THE INVENTION

The present invention relates to a plug-in connector for an electrical system, in particular for motor-vehicle instrument clusters, in which an electric contact arranged in a first connector part can be detachably connected to a mating contact fastened in a second connector part.

In accordance with Federal Republic of Germany 22 45 033 C2, a plug-in connector for motor vehicles is known which has, within a housing, a plurality of insertion openings which have electric leads provided with contact springs. By means of a turnable switch shaft, an actuating device is moved for the making and breaking of electrical contacts. Simultaneously with the pressing of the contacts of the contact springs of the insertion openings against contact tongues of plug-in units which are introduced into said insertion openings, the inserted plug-in units are locked in position.

Modern motor vehicles are provided with a large number of measuring devices, the indicating instruments and indicating lights of which are combined on the instrument panel in an indicating device, the so-called instrument cluster, which lies within the field of view of the driver. Such an instrument cluster consists, in general, of a housing containing a circuit board which bears the conductive paths for the voltage supply and measurement, and also bears the indicating instruments and indicating lights.

In certain cases, a cable-harness connector for making the electrical contact is installed permanently on the instrument panel of the motor vehicle. The instrument cluster also has a connector which can be placed in form-locked manner on the cable-harness connector.

This has the disadvantage that a certain amount of force must be expended in order to make the contact. The electrical contacts are thereby subjected to strong mechanical stresses, which not infrequently leads to a poor contact.

In order to keep the assembly-line times of vehicles in course of construction short, there is furthermore an increasing demand on the part of the automobile plants that the components delivered be, insofar as possible, ready for operation and capable of being installed as simply and as fast as possible. In the case of the above-mentioned instrument cluster, this means that the information systems contained therein are already adjusted upon delivery and that the complete instrument cluster can be installed at the place intended for in the instrument panel with as few operations as possible.

SUMMARY OF THE INVENTION

It is an object of the invention to provide a connector for an instrument cluster which can be fastened in a simple and inexpensive manner to the instrument panel and at the same time permits the reliable making of electric contact.

In accordance with the invention, this is achieved in the manner that, by a linear movement of an actuating device (12, 22) within a first connector part (3) which has the electric contact (4) and is fastened on a circuit board (5), the electric contact (4) can be contacted with a mating electric contact (10). In this matter, the second connector part (7) is firmly connected to a support element (8) and, during the contacting of contact (4) and the mating contact (10), the first connector part (3) can be locked to the support element (8) by a locking device (20) which extends beyond the first connector part (3) in direction of movement and is connected to the actuating device (12, 22).

By only a single manipulation there is effected both the contacting and the secure locking of the instrument cluster in the instrument panel of the motor vehicle.

The advantage of the invention is that a reduction of the force of insertion is made possible upon the bringing together of the instrument cluster and the electrical system of the motor vehicle. Mechanical stressing of the electrical contacts during the making of contact is avoided.

The locking device (20) in this connection advantageously engages through the support element (8) and can be locked on the side of the support element (8) facing away from the first connector part (3). In this way, a particular robustness upon the mounting of the instrument cluster in the motor vehicle is assured.

In one development, the actuating device, which is developed as lever system, consists of a slide (12) which is movable parallel to the circuit board (5) by means of an actuating lever (22). The slide (12) preferably has regions of different cross section. By these simple means the result is obtained that, solely by the movement of the slide, the electric contacting can be effected and the electric contact is again opened and that the locking and unlocking of the entire system is effected.

In a further development, the electric contacts (4) of the first connector part (3) are developed as a spring element, which, depending on what cross sectional region of the slide (12) they are opposite, are pressed, or prestressed, against the electric mating contacts (10) of the second connector part (7).

In this way, an automatic assembling is assured in rapid and simple manner.

According to a feature of the invention, the support element (8) is the instrument panel of a motor vehicle.

According to another feature of the invention, the first connector part (3) is connected with the housing (2) of an instrument cluster (1) and with the circuit board (5) of the instrument cluster (1).

BRIEF DESCRIPTION OF THE DRAWINGS

With the above and other objects and advantages in view, the present invention will become more clearly understood in connection with the detailed description of preferred embodiments, when considered with the accompanying drawings, of which:

FIG. 2 comprises FIGS. 2*a* and 2*b* which show the development of the electric contacts in the plug-in connector of FIG. 1.

DETAILED DESCRIPTION OF THE PREFERRED EMBODIMENTS

Figure 1:
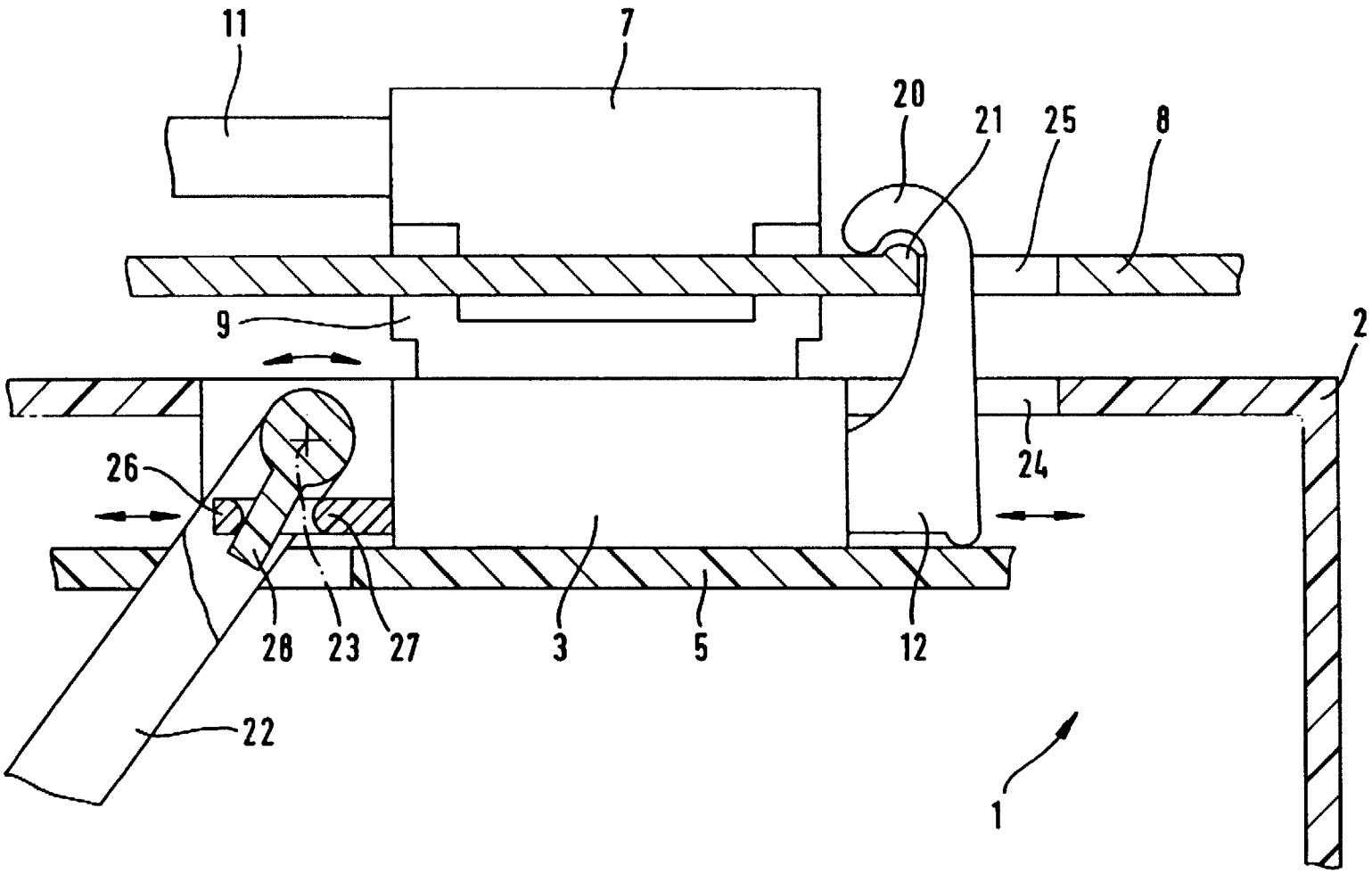
FIG. 1 shows a plug-in connector in accordance with the invention.

FIGS. 1 and 2 show a plug-in connector in accordance with the invention in the successive phases of the contacting. By means of this connector a completely prefabricated instrument cluster is installed in the motor vehicle.

The contacting of the instrument cluster 1 is effected in the manner that the connector box 3 is pushed onto a plug-contact connector in the form of a cable-harness connector 7.

The cable-harness connector 7 is installed in fixed position on the instrument panel 8 of the motor vehicle and has a connector housing 9 adapted to the box-shaped connector 3 so that a form-locked connection is produced upon the contacting.

As shown in FIG. 1, the cable-harness connector 7 which is firmly anchored in the instrument panel 8 of the motor vehicle and, in particular, its connector housing 9, engages in the connector box 3 which is fastened on the circuit board 5.

The connector box 3 is so arranged in the housing 2 of the instrument cluster 1, particularly in the bottom thereof, that it can come into contact with the cable-harness connector 7.

A slide 12 is moved by an actuating lever 22 through the connector box 3 parallel to the circuit board 5. The part of the slide 12 which extends beyond the connector box 3 is developed as a detent hook 20. This detent hook 20 engages through an opening 24 in the housing 2 of the instrument cluster 1, and an opening 25 of the instrument panel 8 onto the rear side of the instrument panel 8.

By means of a driver hook 28 arranged on a shaft 23 is present on a stop 27, the instrument panel 8 and the instrument cluster 1 can be disconnected. If the driver hook 28 is brought by an actuating lever 22, and via a shaft 23, against a stop 26, the slide 12 moves in a linear movement. The detent hook 20 engages with a detent projection 21 present on the side of the instrument panel 8 facing away from the instrument cluster 1. In this way, the instrument cluster 1 is fastened and locked in the instrument panel 8 of the motor vehicle. At the same time, the contacts 4 (FIGS. 2*a*, 2*b*) of the connector box 3 are contacted with the mating contacts 10 of the cable-harness connector 7, as shown in top view in FIG. 2.

FIG. 2*a* shows the released position and FIG. 2*b* the engaged position. The slide 12 is arranged centrally in the connector box 3. Symmetrical to the slide 12 there are two arms 29 and 30 on which, spaced uniformly apart, there are fastened the electric contacts 4, which are developed as contact springs.

Upon introduction of the cable-harness connector 7 into the connector box 3, electric mating contacts 10 of the cable-harness connector 7 are positioned opposite respective ones of the electric contacts 4.

The electric mating contacts 10 of the cable-harness connector 7 are developed as flat contacts which are fastened on a second circuit board on the inside of the connector housing 9 of the connector box 3 of the cable-harness connector 7. Via this second circuit board, the mating contacts 10 are connected to the corresponding connections of the cable-harness 11 (FIG. 1), which are not further shown.

In the open state, the electric contacts 4 lie in each case in a recess 31 in the slide 12, so that no forces are exerted on the contacts.

Upon actuation of the lever 22 by the slide 12, a linear movement is carried out parallel to the contacts 4 and mating contacts 10. The contact springs 4 are tensioned by an increase in cross section 32 of the slide 12, in the manner of a cam, and are pressed against the mating contacts 10 of the cable-harness connector 7. Electrical contact is thus produced between circuit board 5 and cable harness 11.

I claim:

1. A plug-in connector for an electrical system, being suitable for mounting to a support element defining a support panel of a motor vehicle instrument cluster, comprising:

a first connector part comprising a circuit board, a plurality of first electric contacts, an actuating device, a locking device, and a box enclosing said first electric contacts and engaging a side of said circuit board;

a second connector part comprising a plurality of second electric contacts and a housing to be received in said first connector part, said first electric contacts being detachably connectable to said second contacts;

wherein said housing of said second connector part is firmly connectable to said support panel wherein said support panel has an opening;

wherein by a linear movement of the actuating device within the first connector part, subsequent to a receiving of said first connector part by said housing of said second connector part, said first electric contacts engage said second electric contacts; and during an engagement of said first electric contacts with said second contacts, the first connector part is lockable through the opening of said support panel by the locking device, the locking device extending beyond an end portion of said first connector part in a direction of movement of the actuating device and being connected to the actuating device.

2. A connector according to claim 1, wherein the first connector part is lockable to said support panel by contact of the locking device with a side of said support panel facing away from the first connector part.

3. A connector according to claim 1, wherein the actuating device comprises a lever system including an actuating lever and a slide, the slide being movable in a direction parallel to the circuit board by operation of said actuating lever.

4. A connector according to claim 3, wherein the slide has regions of different cross section.

5. A connector according to claim 4, wherein respective ones of said first electric contacts of said first connector part comprise spring elements which undergo stressing and unstressing depending on locations of the cross sectional regions of the slide relative to said first electric contacts, said first electric contacts being urged against said second electric contacts of said second connector part during a state of stressing of the respective elements.

6. A connector according to claim 1, wherein said instrument cluster has a housing; and said first connector part is connected with said housing of said instrument cluster and with said circuit board.

7. A plug-in connector for an electrical system, being suitable for mounting to a support element defining a support panel of a motor vehicle instrument cluster, comprising:

a first connector part comprising a circuit board, a first electric contact, an actuating device, a locking device, and a box enclosing said first electric contact and engaging a side of said circuit board;

a second connector part comprising a second electric contact and a housing to be received in said first connector part, said first electric contact being detachably connectable to said second contact;

wherein said housing of said second connector part is firmly connectable to said support panel wherein said support panel has an opening;

wherein by a linear movement of the actuating device within the first connector part, subsequent to a receiving of said first connector part by said housing of said second connector part, said first electric contact engages said second electric contact; and during an engagement of said first electric contact with said second contact, the first connector part is lockable through the opening of said support panel by the locking device, the locking device extending beyond an end portion of said first connector part in a direction of movement of the actuating device and being connected to the actuating device.

* * * * *